US008006602B2

(12) United States Patent
Myrick

(10) Patent No.: US 8,006,602 B2
(45) Date of Patent: Aug. 30, 2011

(54) COMBUSTION POWERED PNEUMATIC AUGMENTED GUN

(76) Inventor: Donal Richard Myrick, Shalimar, FL (US)

( * ) Notice: Subject to any disclaimer, the term of this patent is extended or adjusted under 35 U.S.C. 154(b) by 312 days.

(21) Appl. No.: 12/490,061

(22) Filed: Jun. 23, 2009

(65) Prior Publication Data

US 2010/0300709 A1 Dec. 2, 2010

Related U.S. Application Data

(60) Provisional application No. 61/075,074, filed on Jun. 24, 2008.

(51) Int. Cl.
*F41A 1/00* (2006.01)

(52) U.S. Cl. ..... 89/7

(58) Field of Classification Search ..... 89/7, 8, 89/1.1; 169/70, 91; 124/75, 56
See application file for complete search history.

(56) References Cited

U.S. PATENT DOCUMENTS

| | | | | | |
|---|---|---|---|---|---|
| 343,556 | A * | 6/1886 | Wheeler | 89/7 |
| 387,517 | A * | 8/1888 | Jackson | 124/73 |
| 1,183,644 | A * | 5/1916 | Hill | 124/75 |
| 1,219,703 | A * | 3/1917 | Clarke | 89/1.11 |
| 1,290,596 | A * | 1/1919 | Lewis | 89/7 |
| 1,320,233 | A * | 10/1919 | Jamerson | 89/7 |
| 2,872,846 | A * | 2/1959 | Crozier | 89/7 |
| 4,269,107 | A * | 5/1981 | Campbell, Jr. | 89/7 |
| 4,726,767 | A * | 2/1988 | Nakajima | 432/222 |
| 4,895,062 | A * | 1/1990 | Chryssomallis et al. | 89/7 |
| 4,951,644 | A * | 8/1990 | Bon | 124/75 |
| 5,476,378 | A * | 12/1995 | Zagoroff et al. | 432/222 |
| 5,499,567 | A * | 3/1996 | Gay | 89/7 |
| 5,631,436 | A * | 5/1997 | Brown et al. | 89/8 |
| 7,356,942 | B2 * | 4/2008 | Lin | 34/96 |
| 7,686,005 | B2 * | 3/2010 | Adams | 124/77 |
| 7,770,504 | B2 * | 8/2010 | Tippmann et al. | 89/7 |

* cited by examiner

*Primary Examiner* — Michael Carone
*Assistant Examiner* — Reginald Tillman, Jr.

(57) ABSTRACT

A combustion powered, pneumatic augmented gun system is disclosed. The combustion powered, pneumatic augmented gun system may include a gun barrel, a combustion chamber, an augmentation air plenum in fluid communication with the combustion chamber, a trigger valve assembly, a fuel supply tank connected to the combustion chamber disposed to provide a combustible fuel to the combustion chamber, and an air compressor connected to the augmentation air plenum disposed to provide compressed air into the augmentation air plenum. When a projectile is to be fired, fuel is combusted in the combustion chamber providing a flow of gases into the gun barrel. Compressed air from the augmentation air plenum is released to augment the acceleration of the projectile in the gun barrel when pressure in the combustion chamber drops.

10 Claims, 3 Drawing Sheets

COMBUSTION POWERED PNEUMATIC AUGMENTED GUN

RELATED APPLICATIONS

This application claims the benefit of priority of, and incorporates by reference, U.S. provisional patent application No. 61/075,074 filed Jun. 24, 2008.

BACKGROUND OF THE INVENTION

The present invention generally relates to a gun, and more particularly, to a combustion powered and pneumatically augmented gun.

Firefighters may sometimes need a long standoff capability for fighting fires because of the breadth of the fire, the distance imposed by the terrain between the firefighters and the fire, or because of the height from which some fires commence. For example, some wildfires may be broad and overwhelming because of the immense fuel source an outdoor landscape can provide. Hill side areas, in another example, can be far from a usable water source and may be difficult to reach because of the terrain. Also difficult to reach are some fires in high rise buildings that can be set on floors well beyond the reach of conventional firefighting techniques.

One known standoff firefighting solution includes the use of aerial tankers and helicopters to drop water or fire retardants on or in front of the fire. The use of air drops may be constrained by factors such as weather, visibility, wind, safety, the number of operational vehicles available, and the time cycles involved in retrieving and dropping a fire retardant or water. Additionally, for large fires aerial delivery is often ineffective because the retardant never reaches the ground due to the fact that the water content is volatized high in the air and the chemical component is then blown away and dispersed by the winds.

As can be seen, there is a need for an improved standoff apparatus and system to introduce a fire retardant into a remote area.

SUMMARY OF THE INVENTION

In one aspect of the present invention, a combustion powered, pneumatic augmented gun system, comprises a gun barrel configured to carry a projectile; a combustion chamber; an augmentation air plenum in fluid communication with the combustion chamber; a trigger valve assembly connected to the combustion chamber and augmentation air plenum, wherein the trigger valve assembly is disposed between the gun barrel and the combustion chamber and wherein the combustion chamber is between the augmentation air plenum and the trigger valve assembly; a fuel supply tank connected to the combustion chamber disposed to provide a combustible fuel to the combustion chamber; and an air compressor connected to the augmentation air plenum disposed to provide compressed air into the augmentation air plenum, the combustion chamber.

In another aspect of the present invention, a combustion powered, pneumatic augmented gun system, comprises a propellant assembly including, a combustion chamber; and an augmentation air plenum in fluid communication with the combustion chamber; a gun barrel configured to carry a projectile disposed within the propellant assembly wherein the propellant assembly concentrically surrounds the gun barrel; a trigger valve assembly connected to the combustion chamber and augmentation air plenum, wherein the trigger valve assembly is disposed between the gun barrel and the combustion chamber and wherein the combustion chamber is between the augmentation air plenum and the trigger valve assembly; a fuel supply tank connected to the combustion chamber disposed to provide a combustible fuel to the combustion chamber; and an air compressor connected to the augmentation air plenum disposed to provide compressed air into the augmentation air plenum, the combustion chamber.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a combustion powered, pneumatic augmented gun. The combustion powered, pneumatic augmented gun may be employed, in one exemplary environment, as a tool for combating fires from an extended distance. A combustion powered, pneumatic augmented gun according to exemplary embodiments of the present invention may be used to launch frangible projectiles containing a fire retardant agent into areas of intense heat where fire fighting may benefit from a retardant impacting and blanketing an extended area. One may appreciate that a combustion powered, pneumatic augmented gun according to exemplary embodiments of the present invention may introduce fire fighting agents into remote areas typically reachable only by water or fire retardant dropping air vehicles whenever the weather and visibility conditions permit their usage. However, by delivering the retardant encapsulated in a frangible projectile which may easily penetrate the heat bubble of the fire, the problem of having the water component volatized and the chemical component dried and blown away before ever reaching the ground may be overcome.

Stand alone pneumatic powered guns, which typically operate with chamber pressures measured in a few hundred pounds per square inch (psi), have been tried, but they may lack the power necessary to launch heavy frangible projectiles over great distances in a rapid fire mode. Explosive powered guns, such as military artillery, may typically operate with chamber pressures measured in many tens of thousands psi, and as such will crush frangible projectiles during operation, and thus may be unsuitable for this application.

Figure 1:
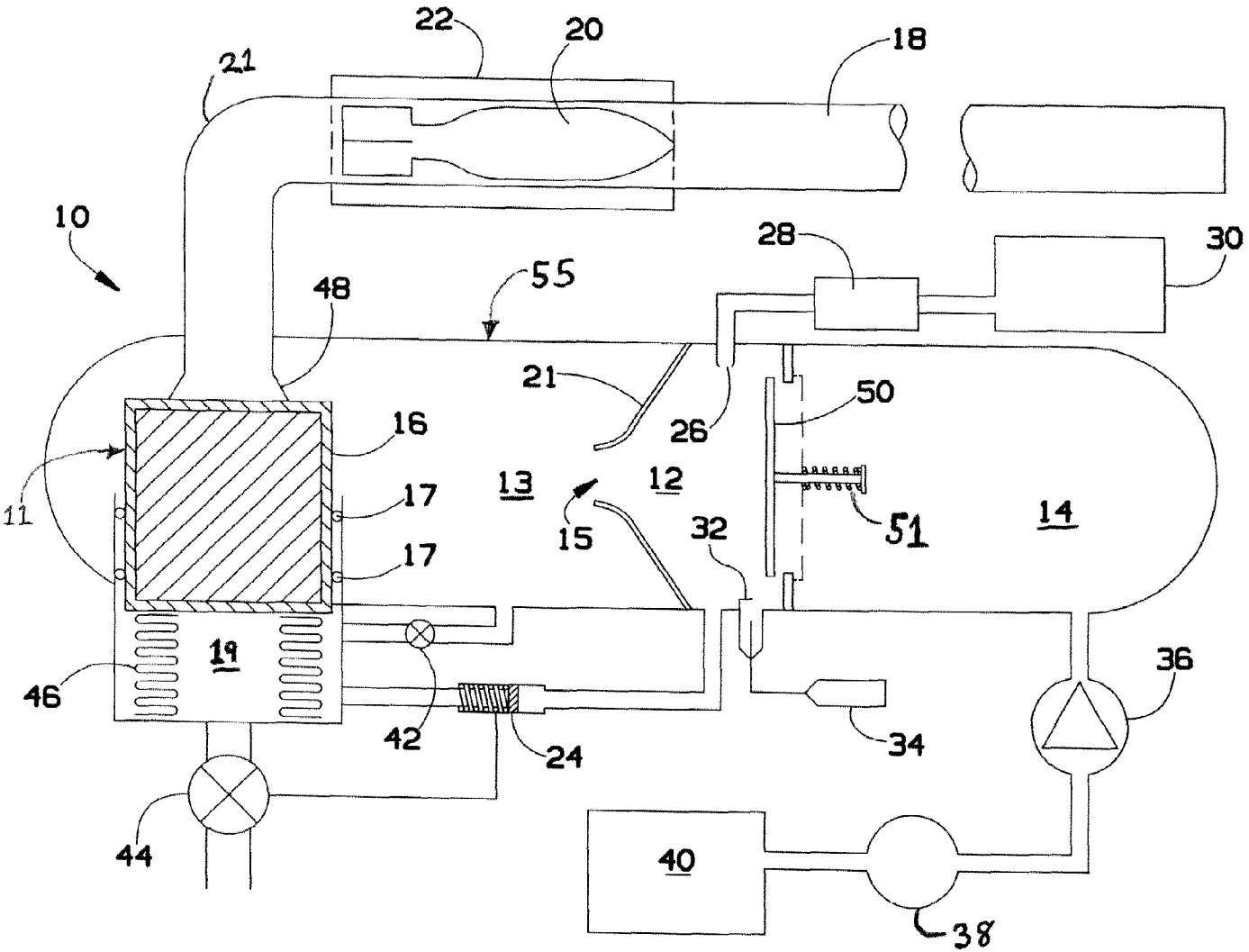
FIG. 1 is a schematic representation of a combustion powered, pneumatic augmented gun system according to one exemplary embodiment of the present invention.
Figure 2:
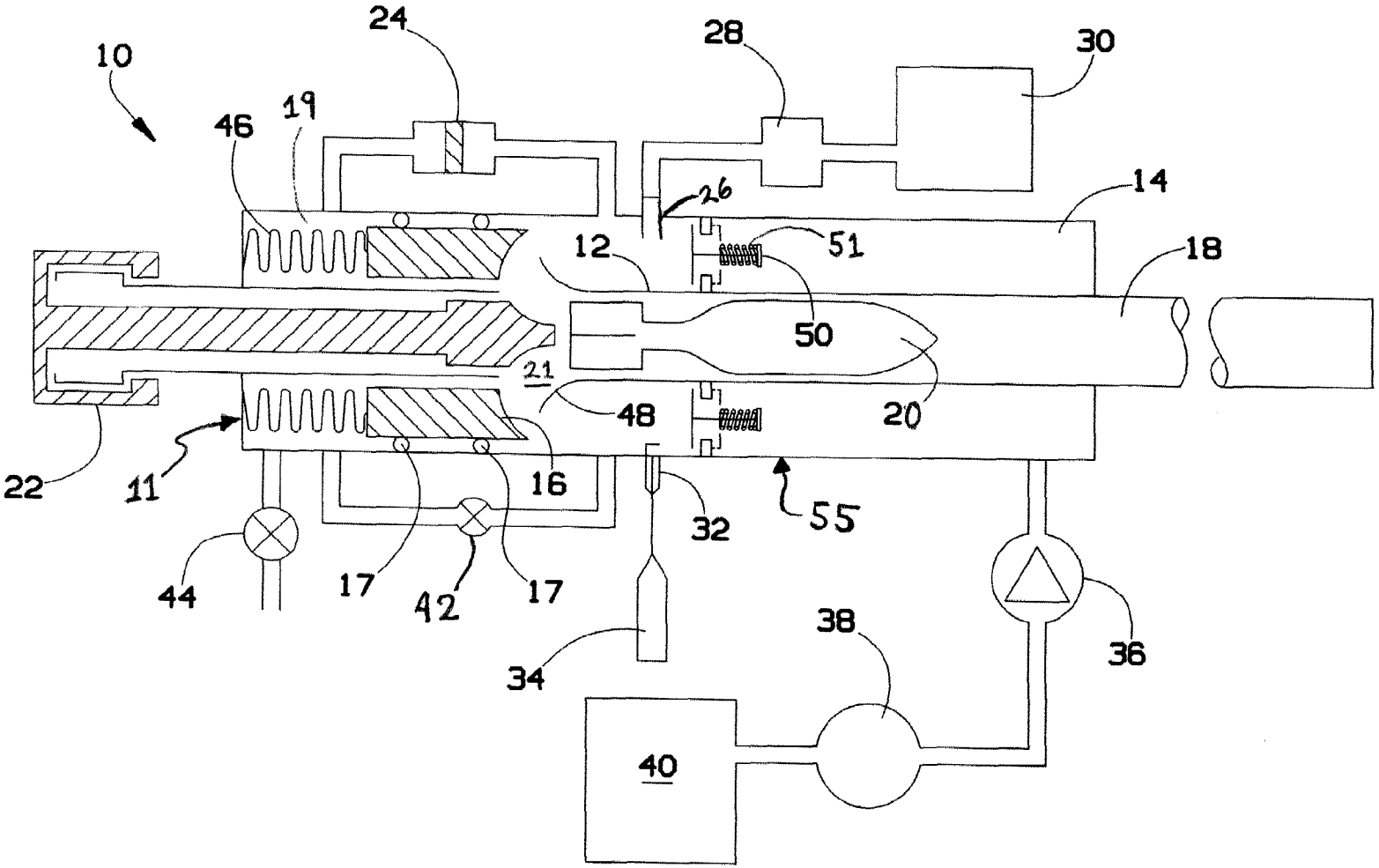
FIG. 2 is a schematic representation of a combustion powered, pneumatic augmented gun system according to another exemplary embodiment of the present invention.

Referring to FIGS. 1 and 2, the combustion powered, pneumatic augmented gun system 10 may generally include a gun barrel 18, a trigger valve assembly 11, a combustion chamber 12, and an augmentation air plenum 14. In one exemplary operation, the combustion powered, pneumatic augmented gun system 10 may be employed to launch a frangible projectile 20 containing a fire retardant agent where upon impact, the frangible projectile 20 may explode and disperse the fire retardant over a distributed area. It will be understood that one or more configurations of the system may be employed and that different types of projectiles may be used depending on the type of retardant used and the situation for operating the combustion powered, pneumatic augmented gun system 10.

Referring to FIG. 1, a linear version of a single barreled gun with a midstream single combustion chamber configuration is depicted. The gun barrel 18 may include a breech 22 for loading the frangible projectile 20 into the gun barrel. A trigger outlet port 21 may bridge the gun barrel 18 to the trigger valve assembly 11. While the combustion powered, pneumatic augmented gun 10 is illustrated with a single barrel 18, it will be understood that one or more barrels 18 may be employed as connected to one or more trigger valve assemblies 11 as needed.

The trigger valve assembly 11 may include an oversized trigger piston 16 disposed within in a trigger port plenum chamber 19 surrounded by gaskets 17. The trigger piston 16 may be biased in a default position by trigger piston springs 46 biasing the trigger piston 16 against a venturi 48 leading into the trigger outlet port 21 where the oversized trigger piston 16 covers the trigger outlet port 21 in its entirety. The trigger valve assembly 11 may be disposed in connection to a propellant assembly 55.

In this exemplary embodiment, the generally cylindrically shaped propellant assembly 55 may include a downstream compressed air plenum 13 in fluid connection to the combustion chamber 12 and the augmentation air plenum 14. As illustrated, the chambers may be configured so that the downstream compressed air plenum 13 surrounds the trigger valve assembly 11 and is disposed downstream from the combustion chamber 12 and the augmentation air plenum 14 with the combustion chamber 12 disposed between the downstream compressed air plenum 13 and the augmentation air plenum 14. The downstream compressed air plenum 13, the augmentation air plenum 14, the trigger valve plenum 19, and the combustion chamber 12 are filled with compressed air and are in equilibrium. A combustion outlet port 15 may define the transition from the combustion chamber 12 into the downstream compressed air plenum 13. The augmentation air plenum 14 may include a backflow inhibitor 50 preventing backflow of combusted gases from the combustion chamber 12 from entering the augmentation air plenum 14. The backflow inhibitor 50 may be biased in a closed position by means of a spring 51, but can open allowing one way fluid communication between the augmentation air plenum 14 and the combustion chamber 12 thus allowing the gasses in all plenums and chambers to be brought to an initial pressure equilibrium.

In a pre-fire state, the trigger port plenum chamber 19 is pressurized to the same pressure as the combustion chamber 12, the augmentation plenum 14, and the downstream compressed air plenum 13. Since the trigger valve piston 16 may be over-sized, in other words, it has a greater cross-sectional area than does the trigger outlet port 21, the pressure in the trigger port plenum chamber 19 may keep the trigger valve assembly tightly closed.

The combustion chamber 12 may be fitted with a fuel injection port 26 and an ignition device 32. A fuel injection pump 28 may be connected to the fuel injection port 26 pumping fuel into the combustion chamber 12 from a fuel supply tank 30. The ignition device 32 may be, for example, a spark plug triggered by an ignition source 34 such as a high voltage spark source.

An air compressor 40 may be connected to a regulator 38 and a check valve 36 to supply compressed air into the augmentation air plenum 14 and to the downstream chambers as well.

The combustion powered, pneumatic augmented gun system 10 may also include a restrictor valve 42 which prevents the flow of the combustion gasses into the trigger valve plenum chamber 19 from the downstream air plenum 13. A fast reaction dump valve 44 may be connected between the trigger valve plenum chamber 19 and ambient air to the exterior of the combustion powered, pneumatic augmented gun system 10.

Disposed between the trigger valve assembly 11 and the combustion chamber 12 may be a fast reacting differential pressure sensing switch 24. In the pre-fire state, this switch will be in the open position and electrically connected to the fast reaction dump valve 44.

Figure 3:
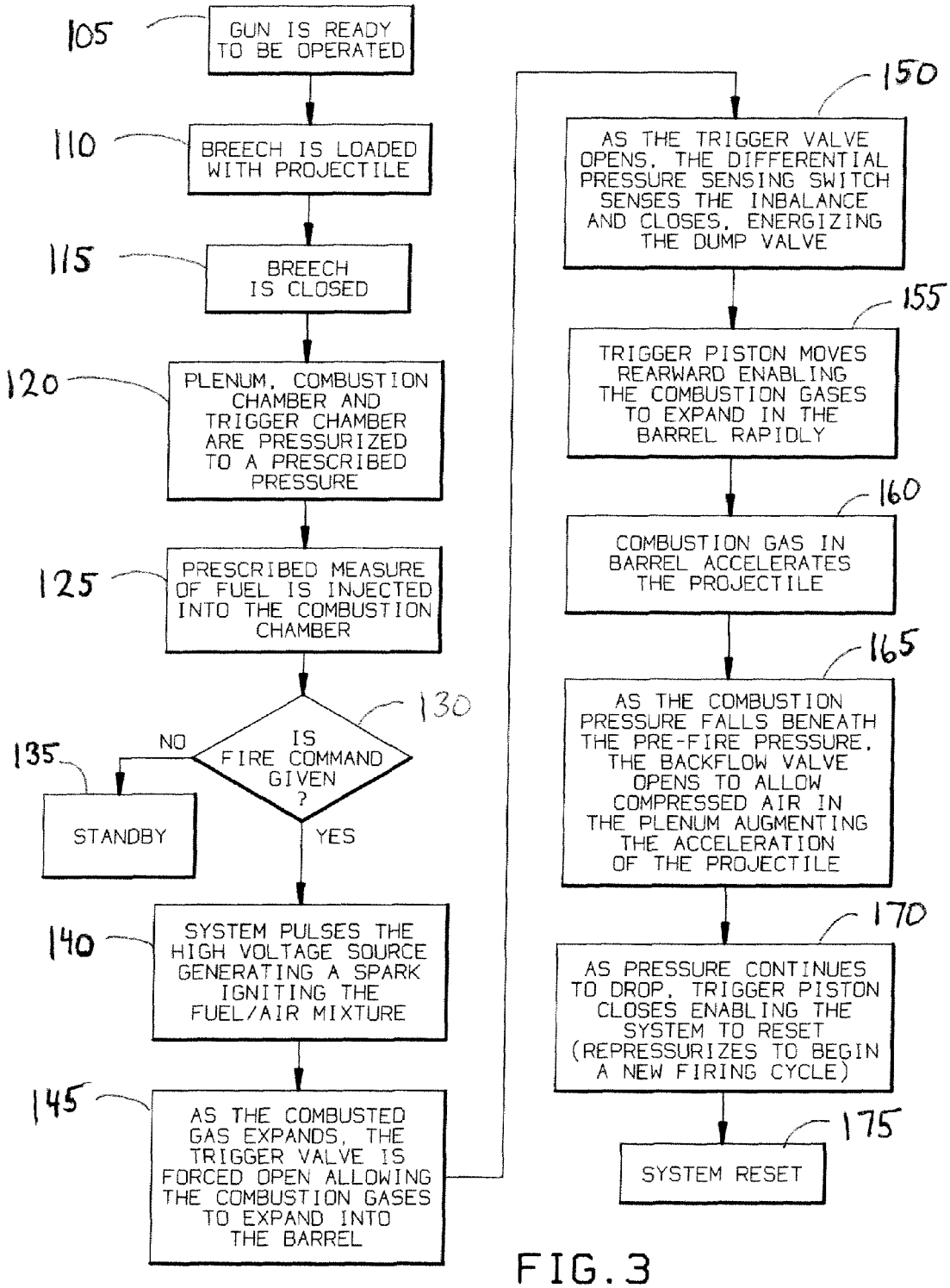
FIG. 3 is a flow chart illustrating an exemplary operation of a combustion powered, pneumatic augmented gun system according to one exemplary embodiment of the present invention.

Referring to FIGS. 1 and 3, in operation, when the combustion powered, pneumatic augmented gun system 10 is ready to be operated (Step 105), a projectile 20 is loaded into the breech 22 (Step 110). The breech 22 is closed (Step 115), and then the downstream compressed air plenum 13, the combustion chamber 12, the augmentation air plenum 14, and the trigger valve plenum chamber 19 may all be pressurized to a prescribed pressure (Step 120). It will be understood that a pressure may be prescribed for a given fuel type to yield a desired pressure after combustion. Then a prescribed measure of fuel is injected into the combustion chamber 12 (Step 125), and a fire command is initiated (Step 130). Otherwise, the system 10 may be on standby (Step 135) Upon receiving the fire command, the high voltage source 34 may generate a sequence of sparks across the spark plug 32 gaps igniting the fuel/air mixture in the combustion chamber 12 (Step 140). It will be understood that in embodiments employing multiple combustion chambers 12, the fuel/air mixture within each combustion chambers 12 may be ignited sequentially.

As the heated combusted gases expand, the back flow inhibitor 50 may be forced rearward sealing off flow of the combusted gases into the augmentation air plenum 14 where they may instead flow towards the trigger valve assembly 11 (Step 145). As the differential pressure sensing switch 24 senses the rise in pressure in the combustion chamber 12, it may activate, in other words, send a signal to open the dump valve 44 (Step 150). The opening of the dump valve 44 may release the compressed air in the trigger valve plenum chamber 19 out of the dump valve 44 thus releasing the bias force the compressed air in the trigger plenum and the trigger piston springs 46 impart on the trigger piston 16. The combination of the rising pressure in the combustion chamber 12 and the drop in pressure in the trigger valve plenum chamber 19 may allow the expanding combustion gases to rapidly force the trigger valve assembly 11 into a fully open position with the trigger piston 16 forced rearward into the trigger valve plenum chamber 19 (Step 155). The combustion gases may then provide a first flow of gases into the venturi 48 where by virtue of the venturi, the first flow may be accelerated into the trigger outlet port 21 and into the gun barrel 18 commencing acceleration of the projectile 20 through the gun barrel 18 (Step 160).

As the pressure in the combustion chamber 12 falls below the pre-fire pressure, the backflow inhibitor 50 may move back towards its open position and the restrictor valve 42 may also open. Thus, the compressed air in the augmentation air plenum 14, may rapidly flow toward the lower pressure areas of the combustion chamber 12 vacated by the combusted gases into the downstream air plenum chamber 13 and into the trigger valve assembly 11 where the trigger piston remains temporarily depressed allowing a continuation (secondary) flow of gases into the venturi 48. Thus, the compressed air from the augmentation air plenum 14 may also continue rapidly toward the trigger outlet port 21 and into the gun barrel 18 to augment the acceleration of the projectile 20 out through the gun barrel 18 (Step 165).

As may be appreciated, augmentation of the projectile 20 acceleration by means of the compressed air from the augmentation air plenum 14 augmenting the pressure wave caused by the combusted gases in the combustion chamber 12 may provide for a long, fairly uniform power stroke. As the compressed air sweeps through the combustion chamber 12, it may also sweep the combustion chamber 12 clean of the combustion gasses. As the pressure in the propellant assembly 55 continues to drop, the trigger piston 16 closes enabling the combustion powered, pneumatic augmented gun 10 to re-pressurize to begin a new firing cycle (Step 170). Thus, the system may be reset to a pre-fire state of pressurized equilibrium (Step 175).

Referring to FIG. 2, another exemplary embodiment of the combustion powered, pneumatic augmented gun system 10 is depicted showing a concentric version of a single barreled, downstream, single combustion chamber configuration. According to this exemplary embodiment, the combustion powered, pneumatic augmented gun system 10 is similar to the embodiment shown in FIG. 1 except that the gun barrel 18 may be disposed at the center of a concentrically surrounding propellant assembly 55, and an air augmentation plenum 14. A downstream compressed air plenum 13 may or may not be eliminated, and a trigger piston 16 may be employed in the trigger valve assembly 11.

The remaining elements such as the augmentation air plenum 14, the backflow inhibitor device 50, the trigger piston springs 46, the trigger piston plenum chamber 19, the gaskets 17, the outlet port 21, the venturi 48, the fuel tank 30, the fuel pump 28, the fuel injector 26, ignition source 34 and ignition device 32, air compressor 40, regulator 38, the check valve 36, the pressure differential sensing switch 24, the restrictor valve 42, and the dump valve 44 perform similar roles to their equivalents in FIG. 1.

Thus, in operation, the exemplary embodiment depicted in FIG. 2 is similar to the embodiment described in FIG. 1 except that as the fuel/air mixture is ignited in the combustion chamber 12, the combusted gases flow directly to the trigger valve assembly 11 forcing the trigger piston rearward without having to first flow through a downstream air plenum chamber and flow out the trigger outlet port 21 beginning the acceleration of the projectile 20 through the gun barrel 18. Similar to FIG. 1, the augmentation air plenum chamber 14 may be opened and compressed air may be released along a shorter path, sans a downstream air plenum chamber and flow out the trigger outlet port 21 augmenting the acceleration of the projectile 20 out the gun barrel 18.

As may be appreciated, the choice of which exemplary embodiment may be used would depend on the parameters of the specific application. It should be understood, of course, that the foregoing relates to exemplary embodiments of the invention and that modifications may be made without departing from the spirit and scope of the invention as set forth in the following claims.

I claim:

1. A combustion powered, pneumatic augmented gun system, comprising:

a projectile;

a gun barrel configured to carry the projectile;

a combustion chamber;

an augmentation air plenum in fluid communication with the combustion chamber;

a trigger valve assembly connected to the combustion chamber and augmentation air plenum, wherein the trigger valve assembly is disposed between the gun barrel and the combustion chamber and wherein the combustion chamber is between the augmentation air plenum and the trigger valve assembly;

a fuel supply tank connected to the combustion chamber disposed to provide a combustible fuel to the combustion chamber; and an air compressor connected to the augmentation air plenum disposed to provide compressed air into the augmentation air plenum, wherein after combustion gases commence acceleration of the projectile, air in the augmentation air plenum is used to augment the acceleration of the projectile out through the gun barrel.

2. The combustion powered, pneumatic augmented gun system of claim 1, further comprising a downstream compressed air plenum disposed between the trigger valve assembly and the combustion chamber.

3. The combustion powered, pneumatic augmented gun system of claim 2, further comprising a restrictor valve connected between the trigger valve assembly and the downstream compressed air plenum configured to restrict a flow of combustion gases into the trigger assembly valve from the downstream compressed air plenum or the combustion chamber.

4. The combustion powered, pneumatic augmented gun system of claim 1, further comprising a differential pressure sensing switch connected between the trigger valve assembly and the combustion chamber wherein when the differential pressure sensing switch is open, senses a differential rise in pressure between the combustion chamber and the trigger plenum, the differential pressure sensing switch closes.

5. The combustion powered, pneumatic augmented gun system of claim 4, further comprising a dump valve connected between the trigger valve assembly and an ambient air located in an exterior of the combustion powered, pneumatic augmented gun system, and wherein when the differential pressure sensing switch activates, dumps the pressurized air in the trigger plenum to the ambient air thus allowing the trigger piston to move to a fully open position.

6. The combustion powered, pneumatic augmented gun system of claim 1, further comprising a venturi connected between the trigger valve assembly and the gun barrel configured to accelerate gases into the gun barrel.

7. The combustion powered, pneumatic augmented gun system of claim 1, further comprising an ignition device connected to the combustion chamber, wherein the ignition device may ignite the combustible fuel.

8. The combustion powered, pneumatic augmented gun system of claim 1, further comprising a backflow inhibitor device connected to the augmentation air plenum and positioned between the augmentation air plenum and the combustion chamber wherein combusted gases are sealed off from the augmentation air plenum and wherein the backflow inhibitor device is configured to release the compressed air in the augmentation air plenum into the combustion chamber and further into the trigger valve assembly and through the gun barrel providing an augmented acceleration of the projectile through the gun barrel.

9. A combustion powered, pneumatic augmented gun system, comprising:

a projectile;

a propellant assembly including, a combustion chamber; and an augmentation air plenum in fluid communication with the combustion chamber;

a gun barrel configured to carry the projectile disposed within the propellant assembly wherein the propellant assembly and the air augmentation plenum concentrically surround the gun barrel;

a trigger valve assembly connected to the combustion chamber and augmentation air plenum, wherein the trigger valve assembly is disposed between the gun barrel and the combustion chamber and wherein the combustion chamber is between the augmentation air plenum and the trigger valve assembly;

a fuel supply tank connected to the combustion chamber disposed to provide a combustible fuel to the combustion chamber; and an air compressor connected to the augmentation air plenum disposed to provide compressed air into the augmentation air plenum, wherein after combustion gases commence acceleration of the projectile, air in the augmentation air plenum is used to augment the acceleration of the projectile out through the gun barrel.

10. The combustion powered, pneumatic augmented gun system of claim 9, further comprising a trigger piston in the trigger valve assembly positioned biased against a trigger outlet port when the system is in a pressurized state of equilibrium and wherein the trigger piston is configured to move rearward and permit a first flow of gases into the gun barrel during a combustion of the fuel and wherein the trigger piston is configured to remain rearward to permit a continuation flow of gases into the gun barrel during a release of the compressed air from the augmentation air plenum.

* * * * *